US006527413B1

(12) United States Patent
McIngvale

(10) Patent No.: US 6,527,413 B1
(45) Date of Patent: Mar. 4, 2003

(54) CHRISTMAS DECORATIVE LIGHTING ASSEMBLY

(76) Inventor: Linda McIngvale, c/o Westside Tennis Club, 1200 Wilcrest, Houston, TX (US) 77042

( * ) Notice: Subject to any disclaimer, the term of this patent is extended or adjusted under 35 U.S.C. 154(b) by 0 days.

(21) Appl. No.: 09/981,232

(22) Filed: Oct. 17, 2001

(51) Int. Cl.[7] ..... F21V 21/00

(52) U.S. Cl. ..... 362/249; 362/806; 362/123; 362/252

(58) Field of Search ..... 362/249, 252, 362/806, 122, 123

(56) References Cited

U.S. PATENT DOCUMENTS

| | | | | |
|---|---|---|---|---|
| 5,213,519 A | | 5/1993 | Dorfman | |
| 5,526,931 A | * | 6/1996 | White | 206/388 |
| 5,601,361 A | * | 2/1997 | Lawrence | 362/123 |
| 5,951,146 A | | 9/1999 | Lin | |
| 5,971,563 A | | 10/1999 | Maggio | |
| 5,984,491 A | | 11/1999 | Chang | |
| 6,152,576 A | | 11/2000 | Mount | |
| 6,158,878 A | | 12/2000 | Lawrence | |
| 6,203,171 B1 | * | 3/2001 | Sherman, Jr. | 362/121 |
| 6,280,803 B1 | | 8/2001 | Gordy, Jr. | |

* cited by examiner

*Primary Examiner*—Sandra O'Shea
*Assistant Examiner*—Ali Alavi
(74) *Attorney, Agent, or Firm*—Jackson Walker L.L.P.; Robert C. Curfiss

(57) ABSTRACT

Devices and methods for rapidly and conveniently decorating generally cylindrical structures, such as the trunks of outdoor trees, poles and the like. A decorative lighting assembly includes a pair of substantially parallel and rigid hollow side members. A light string is disposed through both of the side members to provide a series of parallel light runs. The two tubular side members are reversably affixable to one another using one or more fasteners. Male and female plug connectors are provided for the light string so that like lighting assemblies may be reversably secured to one another. In operation, the lighting assembly is disposed along side a tree trunk, lighting pole or similar cylindrical structure in a substantially vertical orientation. The two side members are then translated about opposite sides of the cylindrical structure so that the light runs are cause to surround the cylindrical structure. The side members are reversably connected together. Multiple lighting assemblies may be electrically affixed to one another so that a series of cylindrical objects may be decorated.

15 Claims, 2 Drawing Sheets

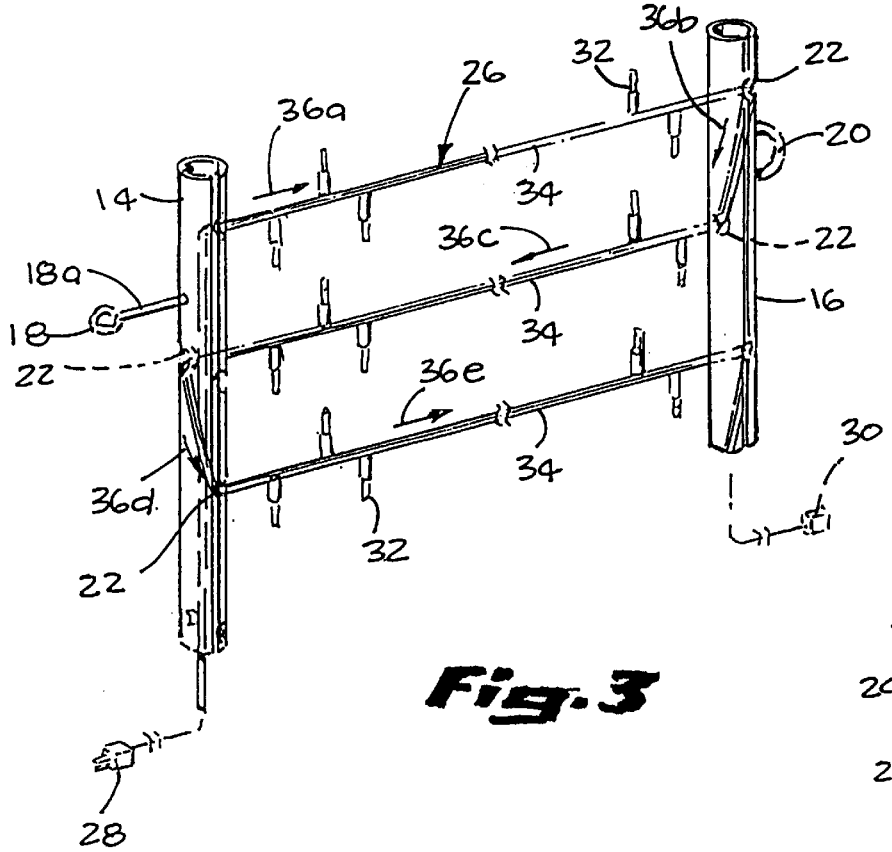
Fig. 3
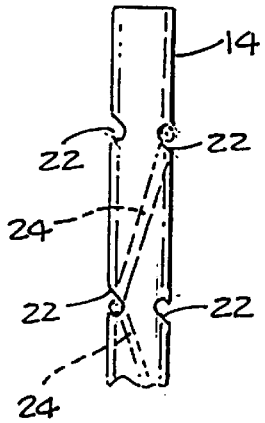
Fig. 4
Fig. 5
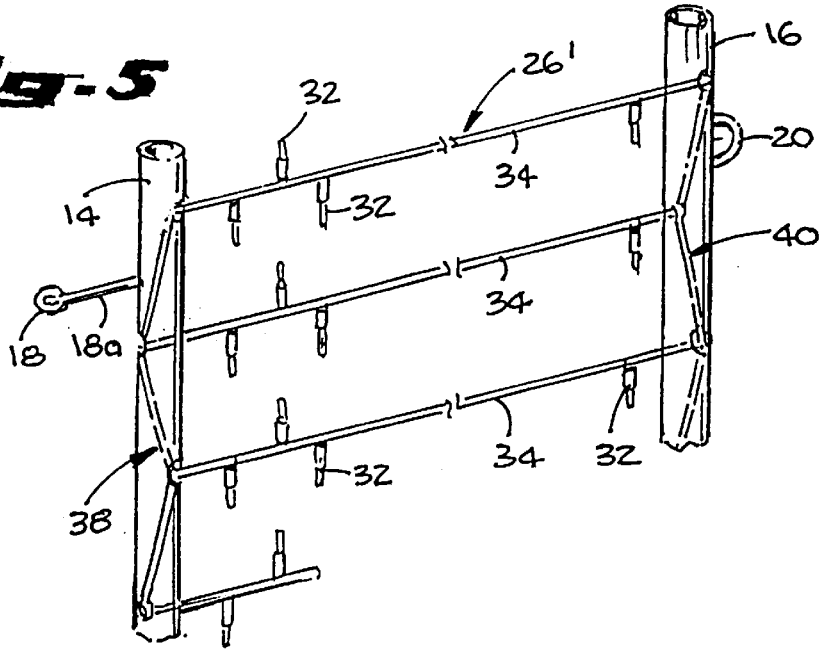

CHRISTMAS DECORATIVE LIGHTING ASSEMBLY

BACKGROUND OF THE INVENTION

1. Field of the Invention

The present invention relates generally to ornamental devices for trees, poles and the like. In preferred aspects, the invention relates to an outdoor decorative lighting assembly for use around the Christmas holidays.

2. Description of the Related Art

Light strings are traditionally used as decorations during the Christmas holidays. Light strings are electrical strings of individual lights, usually connected in parallel circuitry, having plug-type connections on either end. These light strings are draped around Christmas trees and strung along the rooflines of homes. In addition, light strings are often wrapped around the trunks of outdoor trees in a helical manner for decoration in a yard or in commercial settings. As is well know, such decoration is time consuming and may require the use of a ladder or other elevating device to allow one to place the light string at the upper portion of the trunk.

Certain decorative light nets have been developed that are draped over an object, such as a Christmas tree. U.S. Pat. No. 5,601,361 issued to Lawrence, for example, describes a flexible electric light net made to be draped over a plant or other object. Other light nets or light arrays are disclosed in e.g., U.S. Pat. No. 5,971,563 issued to Maggio; U.S. Pat. No. 6,152,576 issued to Mount; and U.S. Pat. No. 5,951,146. Unfortunately, each of these devices lacks the ability to be easily secured to a cylindrical object without the use of additional fasteners. In addition, a ladder or other means would be required to affix the device to the upper portions of a pole, tree trunk or the like.

An improvement that addresses the problems of the prior art would be desirable.

SUMMARY OF THE INVENTION

The present invention provides devices and methods for rapidly and conveniently decorating generally cylindrical structures, such as the trunks of outdoor trees, poles and the like. In a preferred embodiment described herein, a decorative lighting assembly includes a pair of substantially parallel and rigid hollow side members. A light string is disposed through both of the side members to provide a series of parallel light runs. The two side members are reversably affixable to one another using one or more fasteners. Male and female plug connectors are provided for the light string so that like lighting assemblies may be reversably secured to one another.

In operation, the lighting assembly is disposed along side a tree trunk, lighting pole or similar cylindrical structure in a substantially vertical orientation. The two side members are then translated about opposite sides of the cylindrical structure so that the light runs are cause to surround the cylindrical structure. The side members are reversably connected together. Multiple lighting assemblies may be electrically affixed to one another so that a series of cylindrical objects may be decorated.

BRIEF DESCRIPTION OF THE DRAWINGS

FIG. 3 is a detail view of one side of a decorative lighting arrangement constructed in accordance with the present invention.

FIG. 4 is a detail view of a portion of a side support tube.

FIG. 5 is a detail view of one side of a decorative lighting arrangement illustrating an alternative method of arranging a light string within a side support tube.

DETAILED DESCRIPTION OF THE PREFERRED EMBODIMENTS

Figure 1:
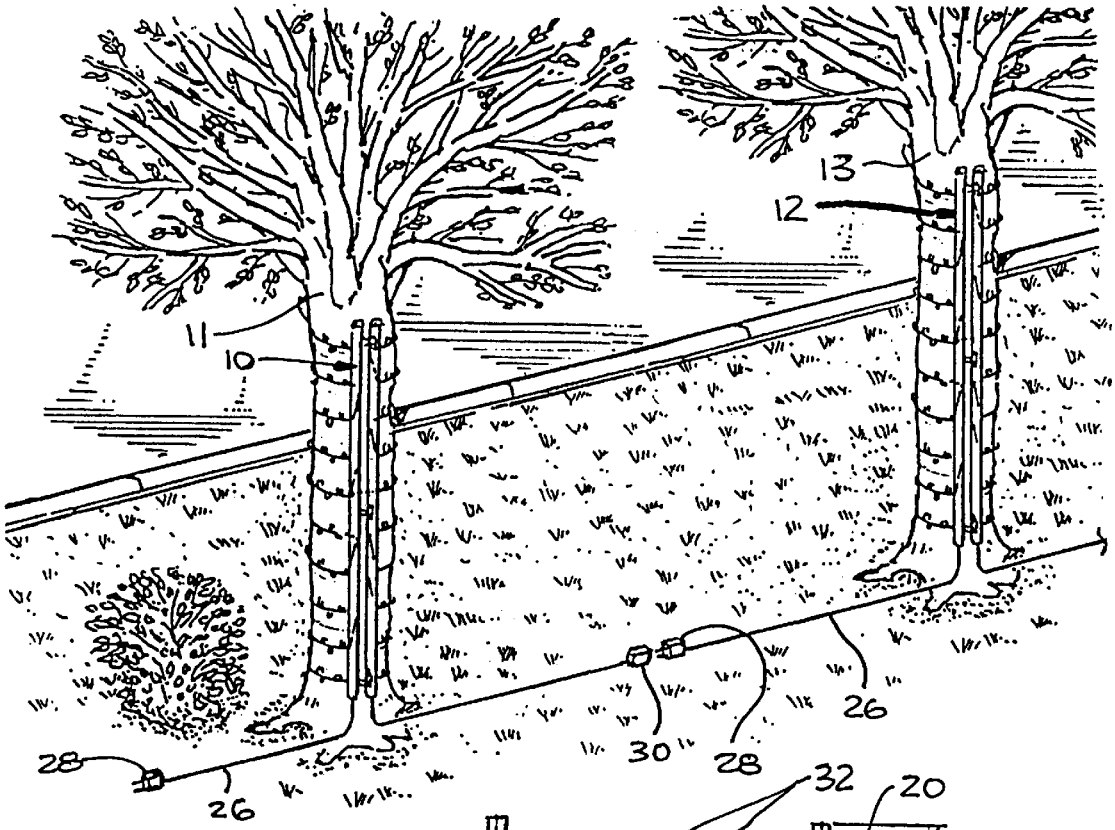
FIG. 1 is an isometric view of a pair of trees that have been decorated using a decorative lighting arrangement constructed in accordance with the present invention.
Figure 2:
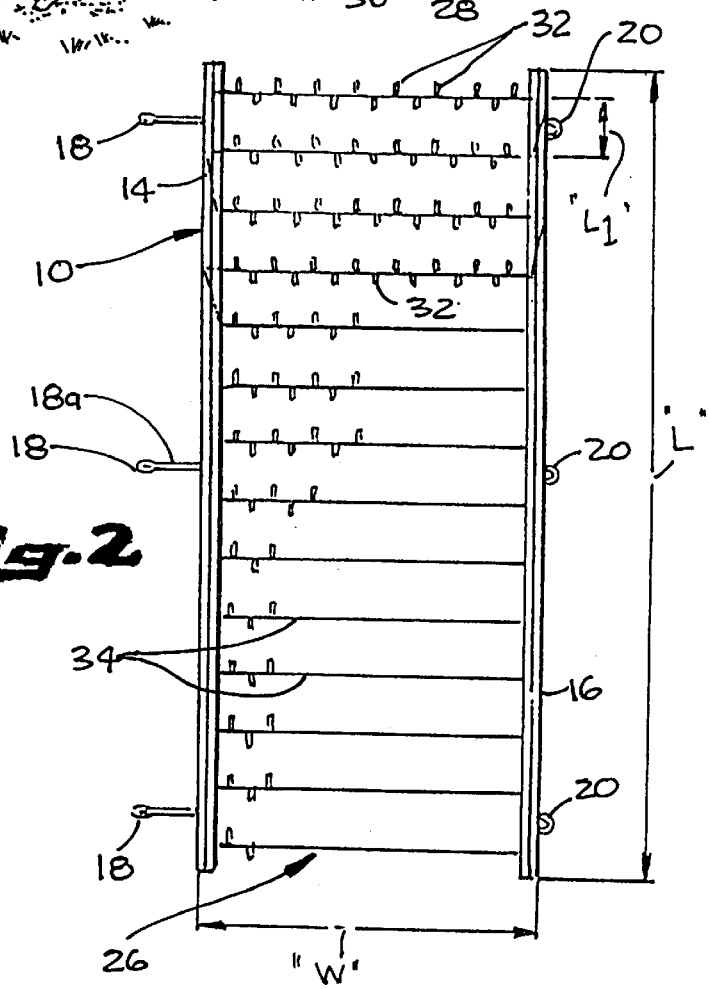
FIG. 2 is a view of a single decorative lighting arrangement constructed in accordance with the present invention.

FIGS. 1–5 illustrate exemplary decorative lighting assemblies that are constructed in accordance with the present invention. FIG. 1 illustrates two lighting assemblies 10, 12 that are being used to decorate a pair of trees 11, 13, respectively. The lighting assemblies 10 and 12 are constructed identically. FIG. 2 shows the decorative lighting assembly 10 apart from other components. As can be seen there, as well as in the detail drawings of FIGS. 3, 4, and 5, the lighting assembly 10 includes a pair of side support tubes 14, 16 that are disposed approximately parallel to one another. Each of the support tubes 14, 16 is a hollow tubular member and is preferably fashioned from a material that is somewhat rigid. Preferred materials for the support tubes 14, 16 are polyethylene and polypropylene. However, numerous suitable materials may be used, including steel and other metals or even wood. The tubes 14, 16 may be clear or opaque and may be of any color. The left side support tube 14 has a number of hook-type fasteners 18 affixed thereto. The hook fasteners 18 are preferably secured to the tube 14 by elastic connecting bands 18*a*. The right side support tube 16 has an equal number of ring-type fasteners 20 that are complimentary to the fasteners 18 so that one may be reversably affixed to the other. It is noted that numerous types of reversably interlocking fasteners may be used as well for reversably affixing the left and right side support tubes 14, 16, including snaps, hooks and buttons. While FIG. 4 depicts the structure of an exemplary section of the left support tube 14, it should be understood that the depicted structure is also representative of the right side support tube 16. As can be seen in FIG. 4, the walls of the tube 14 contain a plurality of rounded apertures 22 that are disposed therethrough. In addition, a series of thin slits 24 are cut into the walls of the tube 14 as well. The slits 24 interconnect pairs of apertures 22.

The lighting assembly 10 also includes an electrical light string 26. The light string 26 is akin to a standard commercially obtainable linear strand of electric Christmas lights and is provided with male and female plug members 28, 30 (see FIG. 3), each of which is located at one end of the light string 26. As noted, the light string 26 may comprise a single linear string, but, as will be described, alternative constructions are possible. A plurality of lights 32 are located at intervals along the light string 26. The light string 26 is disposed through both of the side support tubes 14, 16 in a back and forth manner so that a series of substantially parallel light runs 34 of substantially equal length are established between the side support tubes 14, 16.

FIGS. 3 and 5 depict alternative exemplary techniques of stringing a light string 26 within the support tubes 14, 16 to establish the parallel runs 34. In the first exemplary arrangement, illustrated in FIG. 3, the light string 26 comprises a linear string of paired electrical wiring that carries the individual lights 32 thereupon. The string 26 is strung between the tubes 14, 16 using a laddering, or alternating U stringing method. The light string 26 is run vertically up inside the left support tube 14 and then horizontally across to the right side support tube 16 in the direction of arrow 36*a*. The light string 26 then enters the right side support tube 16 through an upper aperture 22 and is then translated down through the right side support tube 16 as shown by arrow 36*b*. The light string 26 then exits the right side support tube 16 and is strung across to the left side support tube 14, as shown by arrow 36*c*. The light string 26 next enters the left side support tube 14 via another aperture 22 and is translated downwardly through the tube 16 as indicated by arrow 36*d*. The light string 26 is then strung out of a lower aperture 22 across to the right side support tube 16 in the direction of arrow 36*e*. The entire length of the assembly 10 may be strung in this fashion.

As noted, FIG. 5 illustrates an alternative construction for the lighting assembly 10 wherein an alternative light string assembly 26' is used rather than the linear light string 26. Light string assembly 26' is made up of a pair of parallel side runs 38 and 40. The side runs 38, 40 are electrically interconnected by parallel branches that serve to create the individual runs 34. In order to create the lighting assembly 10 using this type of light string assembly 26', the side runs 38, 40 are disposed inside of the support tubes 14, 16 via slits 24. The parallel branches are then aligned with and disposed through the apertures 22 in each of the tubes 14, 16 to provide a plurality of parallel runs 34 that extend from one support tube to the other.

In both stringing arrangements, the light string 26 is disposed longitudinally within, and along the length of, the support tubes 14, 16 by passing it through the slits 24 in the walls of each tube 14, 16. Due to the relative stiffness and shape memory of the tubes 14, 16, the slits 24 tend to remain in a closed configuration when not pried open to permit passage of light strand wiring. While the slits 24 are used to dispose the string 26 longitudinally inside of the tubes 14, 16, the apertures 22 are used to dispose the runs 34 of the string 26 through the tube walls. The edges of the apertures 22 provide a seating surface for the string 26 so that the positions of individual runs 34 are not easily moved about.

In operation, the lighting assemblies 10 may be rapidly and effectively used to decorate a cylindrical object, such as, most typically, a tree trunk for an outdoor tree, a telephone pole, or a pole for a streetlight. The lighting assembly 10 is disposed along side the object, such as tree trunk 11 in FIG. 1 in a substantially vertical orientation. The two side support tubes 14, 16 are then translated about opposite sides of the cylindrical structure so that the light runs are cause to surround the cylindrical structure in a wrap-around fashion. The two support tubes 14, 16 are then affixed to one another using the connectors 18, 20. Disassembly of the lighting assembly 10 is accomplished by reversing the above steps. It is noted that, when the assembly 10 is wrapped around the cylindrical structure in this manner, the support tubes 14, 16 should be located substantially at the rear, or hidden, side of the structure 11. It is noted that the width "w" (see FIG. 2) of the lighting assembly 10 should be established so that the circumference of the object to be decorated is approximated. The elastic connections 18*a* allow some adaptability for the assembly 10 and permit it to be used to wrap objects of various circumferences. The length "L" of the assembly 10 should approximate the height of the area that one desires to decorate.

The invention may be employed where there are a plurality of cylindrical objects spaced at intervals. For example, if there are several trees or streetlight poles spaced along a road, a plurality of assemblies may be used to decorate each of those objects. Further, the assemblies are easily linked to one another electrically by inserting the male plug member 28 from one assembly (12) into the female plug member 30 of the adjoining assembly (10).

Those of skill in the art will recognize that many changes and modifications may be made to the devices and methods of the present invention without departing from the scope and spirit of the invention. Thus, the scope of the invention is limited only by the terms of the claims that follow and their equivalents.

What is claimed is:

1. A decorative lighting assembly comprising:

a pair of side support tubes;

a light string assembly having a plurality of lights thereon, the light string assembly being disposed through each of the side members; and at least one connector for reversably affixing the side support tubes to one another.

2. The decorative lighting assembly of claim 1 wherein the side support tubes are hollow cylindrical members.

3. The decorative lighting assembly of claim 1 wherein the light string assembly forms a plurality of substantially parallel runs between the side support tubes.

4. The decorative lighting assembly of claim 1 wherein the light string assembly comprises a linear string of lights.

5. The decorative lighting assembly of claim 1 wherein the light string assembly comprises a pair of parallel electrical runs having at least one interconnecting run.

6. The decorative lighting assembly of claim 5 wherein there are a plurality of interconnecting runs.

7. The decorative lighting assembly of claim 1 further comprising a pair of plug members for electrical interconnection of the assembly.

8. A decorative lighting assembly for decoration of a substantially cylindrical object comprising:

a pair of side support tubes;

a light string assembly having a plurality of lights thereon, the light string assembly being disposed through each of the side members so as to provide a plurality of substantially parallel light string runs; and at least one connector assembly for reversably affixing the side support tubes to one another.

9. The decorative lighting assembly of claim 8 wherein the connector assembly comprises first and second reversably connectable members.

10. The decorative lighting assembly of claim 8 wherein one of said connectable members is affixed to a side support tube by an elastic connection.

11. The decorative lighting assembly of claim 8 wherein the side support tubes each have a wall with at least one aperture therein.

12. The decorative lighting assembly of claim 11 wherein there are a plurality of apertures therein.

13. The decorative lighting assembly of claim 12 further comprising at least one slit within the wall and interconnecting a pair of apertures.

14. The decorative lighting assembly of claim 8 further comprising at least one electrical plug member for said light string assembly.

15. A method of decorating a cylindrical object comprising the steps of:

wrapping a lighting assembly about a cylindrical object; and securing a pair of tubular members to one another.

* * * * *